US007946784B2

(12) United States Patent
Knak et al.

(10) Patent No.: US 7,946,784 B2
(45) Date of Patent: May 24, 2011

(54) GRATING SYSTEM

(75) Inventors: Ronald L. Knak, Wichita, KS (US); Dean V. Balocca, Wichita, KS (US)

(73) Assignee: Balco, Inc., Wichita, KS (US)

( * ) Notice: Subject to any disclaimer, the term of this patent is extended or adjusted under 35 U.S.C. 154(b) by 34 days.

(21) Appl. No.: 12/499,140

(22) Filed: Jul. 8, 2009

(65) Prior Publication Data

US 2011/0008104 A1 Jan. 13, 2011

(51) Int. Cl.
*E01C 11/02* (2006.01)

(52) U.S. Cl. ..... 404/2; 404/4; 404/47; 404/58; 14/73.1

(58) Field of Classification Search ..... 404/2–5, 404/47, 58; 14/73.1
See application file for complete search history.

(56) References Cited

U.S. PATENT DOCUMENTS

| | | | | |
|---|---|---|---|---|
| 846,291 | A | 3/1907 | Emerson | |
| 1,561,120 | A | 11/1925 | Smith | |
| 2,128,753 | A | 8/1938 | Lienhard | |
| 3,732,021 | A * | 5/1973 | Rizza et al. | 404/57 |
| 3,830,583 | A * | 8/1974 | Becht et al. | 404/69 |
| 3,904,302 | A * | 9/1975 | Bertschmann | 404/68 |
| 4,276,728 | A | 7/1981 | Balzer et al. | |
| 4,968,170 | A | 11/1990 | Wilson et al. | |
| 5,291,714 | A | 3/1994 | Wright et al. | |
| 5,695,842 | A | 12/1997 | Peck et al. | |
| 6,942,419 | B2 | 9/2005 | Knak et al. | |
| 6,968,665 | B2 | 11/2005 | Lawson | |
| 2009/0038235 | A1 * | 2/2009 | Muller et al. | 52/19 |

* cited by examiner

*Primary Examiner* — Raymond W Addie

(74) *Attorney, Agent, or Firm* — Hovey Williams LLP

(57) ABSTRACT

A drainage system grate assembly for covering and allowing fluid passage into a watercourse includes: a crossbar having a plurality of spaced-apart upstanding knuckles defining a plurality of spaced-apart channels therebetween, each of the knuckles having a pin-receiving hole; a plurality of tread bars positioned in the channels between the knuckles of the crossbar, each tread bar having a pin-receiving hole axially aligned with the pin-receiving holes of the knuckles; and a pin positioned within pin-receiving holes in the knuckles and the tread bars, to secure the tread bars in the crossbar.

25 Claims, 3 Drawing Sheets

GRATING SYSTEM

BACKGROUND

The present invention relates to drainage systems. More particularly, the invention relates to drainage system grate assemblies that can be easily removed for cleaning and that can be secured over a drainage system without deforming the grate or causing a tripping hazard.

Drainage system grates are typically comprised of several tread bars and two or more crossbars that drop into frames to cover drainage systems. The frames are typically secured over or within a drainage system while it is being constructed. The frames not only support the grates, but also provide a convenient platform to which the grates may be secured.

Drainage system grates are typically secured to their frames by grate locking assemblies to prevent theft by vandals or thieves and to ensure that the grates don't become unseated when stepped on or driven over. Common grate locking assemblies typically include a grate bar affixed either above or below a few tread bars of a grate. A bolt is used to secure the grate bar to a locking bar, which is located within the drainage system and contacts the grate's frame to prevent the grate from being removed or unseated.

There are two main problems with these prior art grate locking assemblies. One is that the grate bar must be added to an otherwise ready-to-install grate. This complicates the installation and can result in an aesthetically unappealing grate. Another problem is that the grate bar is typically only affixed to some tread bars, thus stressing those tread bars and not others. The stressed tread bars can bend and cause an uneven surface, which is aesthetically unappealing and can present a tripping hazard. Uneven surfaces are a particular problem if the grate assembly is installed near a swimming pool, for example.

Another common grate locking assembly uses a recessed area in two adjacent tread bars of a grate. The recessed area includes a hole through which a bolt penetrates, such that a head of the bolt rests in the recessed area. The bolt is attached to a locking bar below the grate allowing the locking bar to be rotated, such that ends of the locking bar seat within grooves in a frame. The grooves prevent the locking bar and the grate from being removed or unseated. A disadvantage of this construction is that only two tread bars are stressed, which can cause an uneven surface as discussed above.

Accordingly, there is a need for an improved drainage system grate assembly that overcomes the limitations of the prior art. More particularly, there is a need for a drainage system grate assembly that can be secured in place, is easy to disassemble for cleaning, and does not deform when installed.

SUMMARY

The present invention solves the above-described problems and provides a distinct advance in the art of drainage systems. More particularly, the present invention provides a drainage system grate assembly that securely holds its tread bars in place and allows for simple assembly and disassembly, but does not deform when installed.

The drainage system grate assembly of the present invention broadly includes a frame and a grate. The frame defines the lateral edges of the watercourse, supports the grate and may include a liner. The grate includes a crossbar, tread bars and a pin positioned to secure the tread bars within the crossbar. The crossbar includes vertically upstanding sidewalls, a plurality of spaced-apart upstanding knuckles and horizontally extending pin holes.

To install the drainage system grate assembly, the frame and liner are positioned within a watercourse, the tread bars are placed between the knuckles of the crossbar and a pin is positioned within pin holes in the knuckles of the crossbar and the tread bars. The crossbar is secured to the frame by using a locking element that includes a bar and a tightening element. The bar is oriented and then tightened to make contact with a horizontal ledge included on the frame. This secures the crossbar in place, relative to the frame, and secures the pin in place so that it cannot be removed.

Some embodiments of the invention include an end plate to define an end to the grate assembly liner. Other embodiments include splice plates to join multiple grate assembly liners assemblies together. Still other embodiments include frame anchors.

This summary is provided to introduce a selection of concepts in a simplified form that are further described below in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
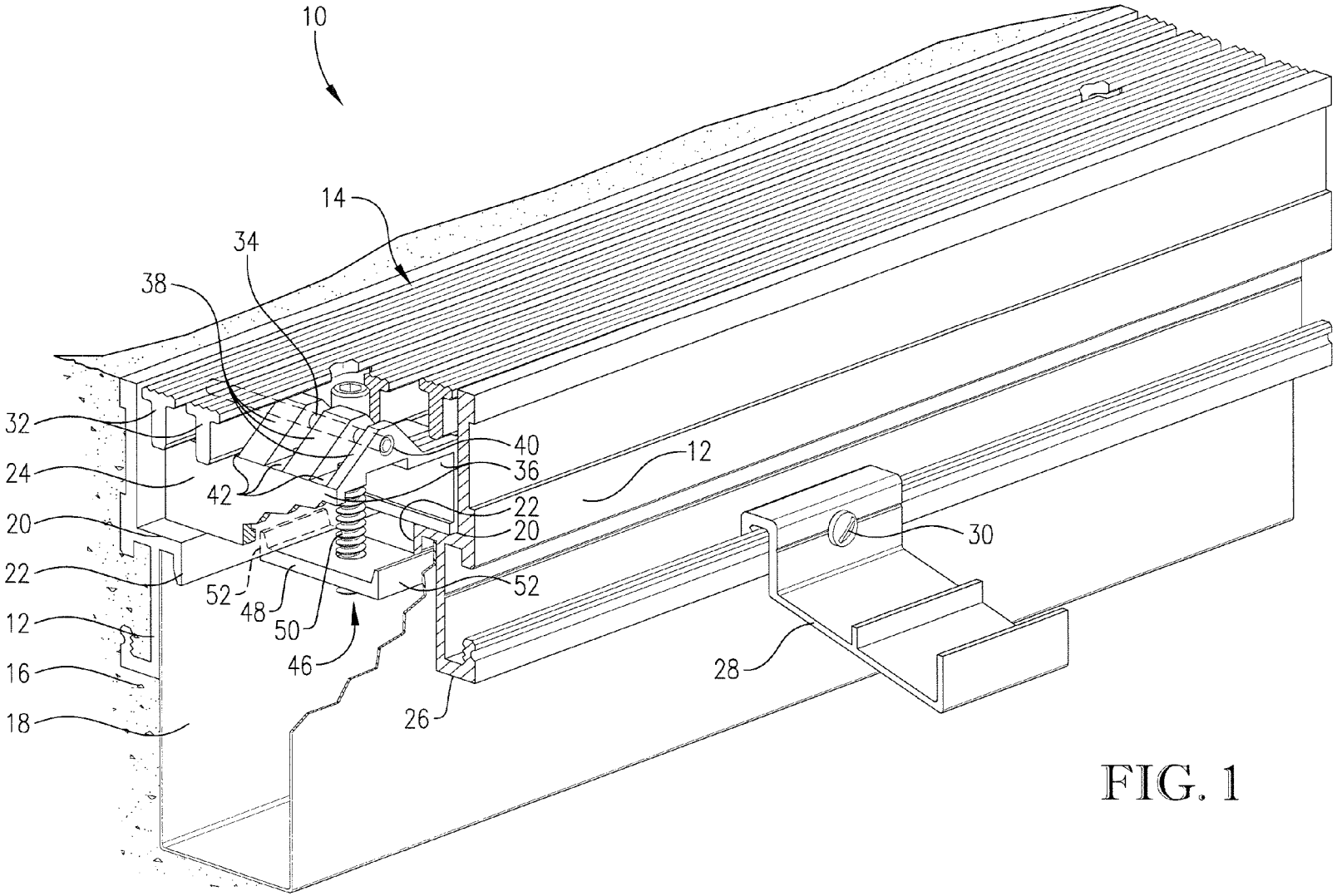
FIG. 1 is a perspective view of a drainage system grate assembly constructed in accordance with an embodiment of the invention and shown installed within a surrounding material with cutaways to show the interrelation of parts.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

Figure 2:
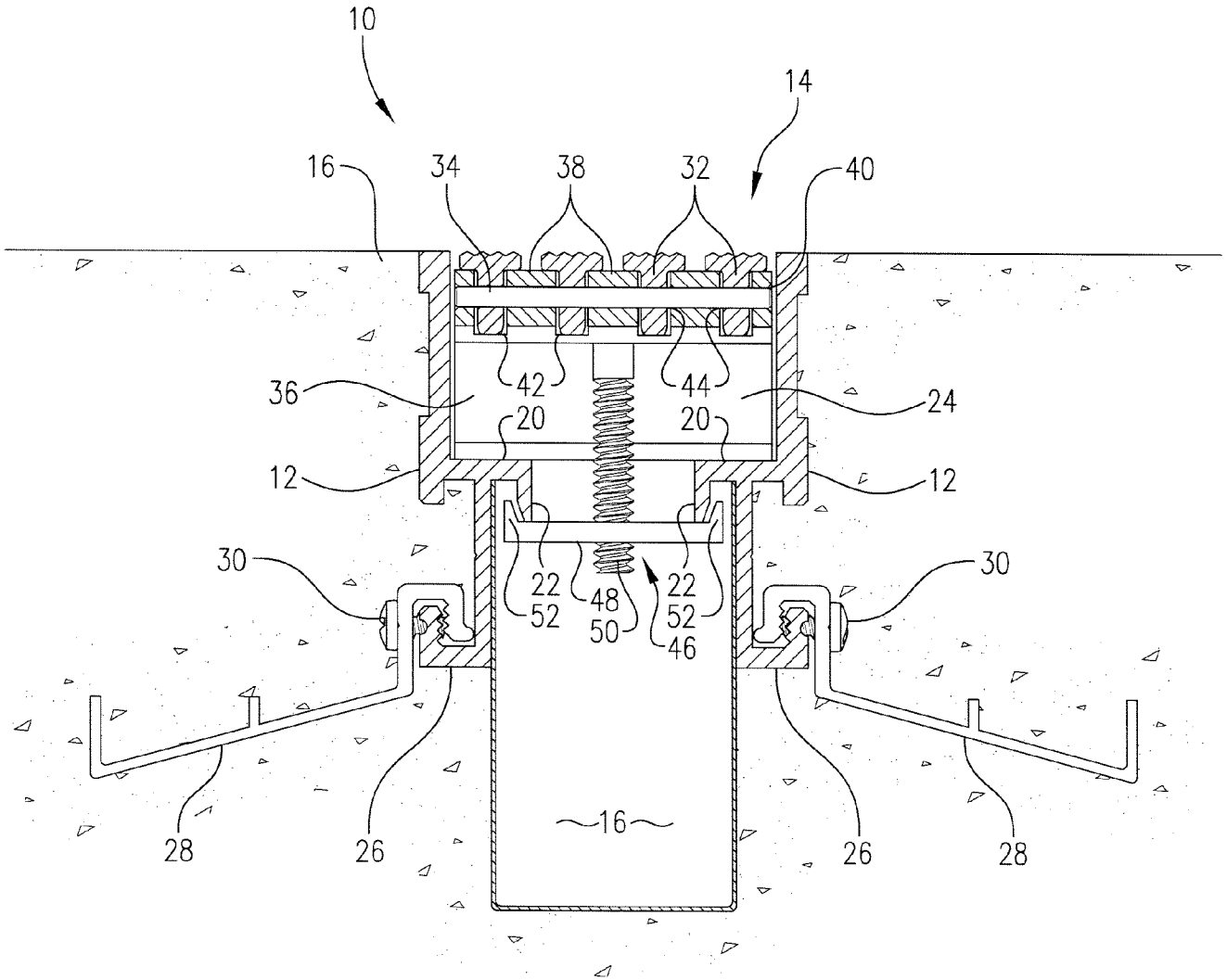
FIG. 2 is a vertical cross-section view of a drainage system grate assembly constructed in accordance with an embodiment of the invention.
Figure 3:
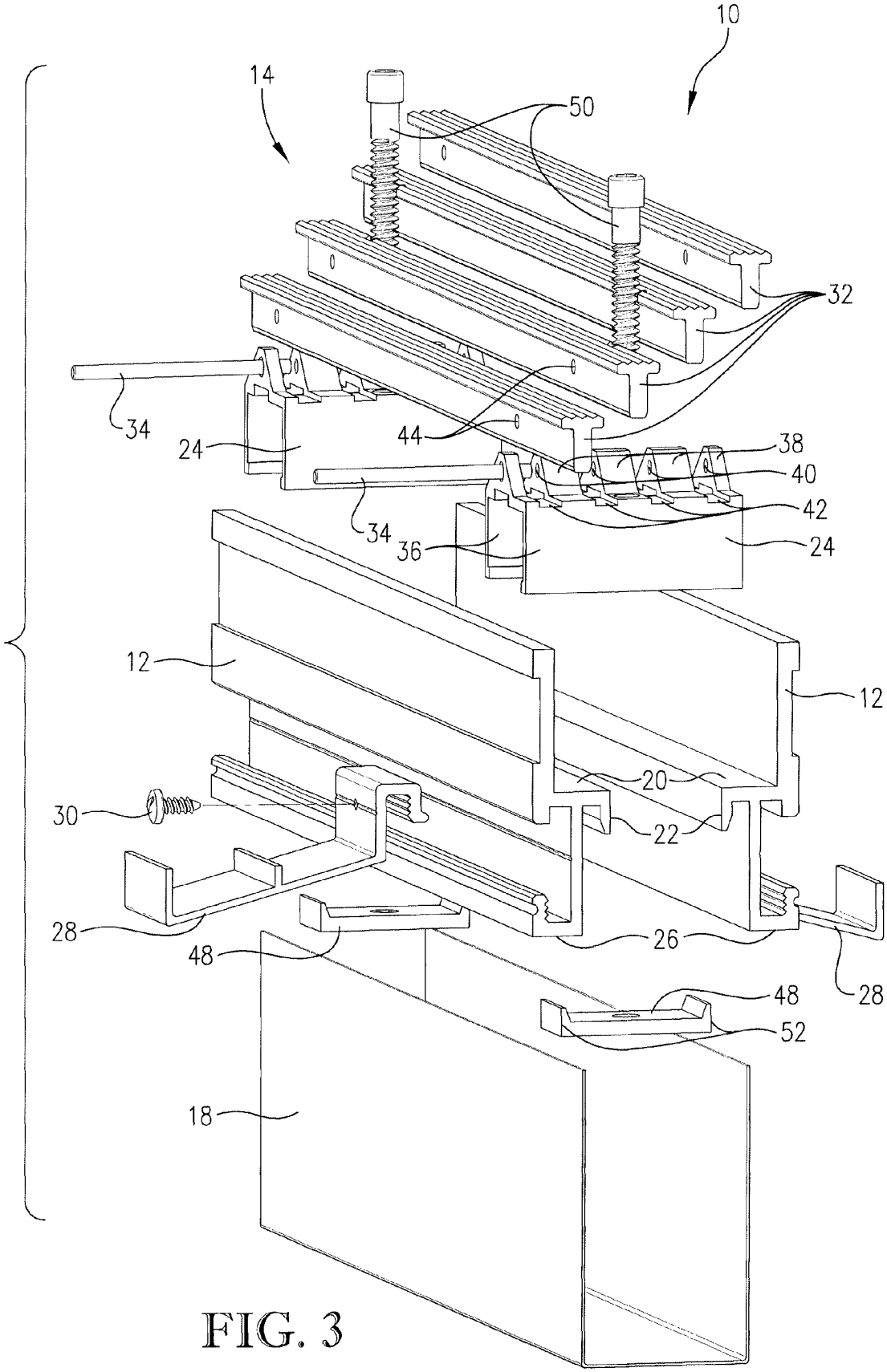
FIG. 3 is an exploded perspective view of the drainage system grate assembly constructed in accordance with an embodiment of the invention.

Turning now to FIGS. 1-3, a drainage system grate assembly 10 constructed in accordance with an embodiment of the invention is illustrated. The drainage system grate assembly 10 is operable for covering a watercourse and broadly includes a frame 12 and a grate 14.

The frame 12 defines the lateral walls of the watercourse within a surrounding material 16, provides support for the grate 14, and may include a liner 18. In one embodiment, the frame 12 is approximately 6.35 cm (2.5 inches) tall, 6.0325 cm (2.375 inches) wide and 60.96 cm (24 inches) long, though the size and proportions may be changed without departing from the scope of the invention. The frame 12 has predominantly vertical sidewalls and a horizontal ledge 20 that protrudes medially toward the opposing side of the frame 12. Additionally, the horizontal ledge 20 may include a shelf 22 that extends downward from the horizontal ledge 20. The surrounding material 16 may be any material, such as concrete or blacktop.

The frame 12 may be constructed of different materials and may be a different shape so long as it is operable to support the grate 14. The frame 12 may be constructed of metal, plastic, concrete or other materials as required by the situation. For example, a plastic or nylon frame may be appropriate in situations where the fluid contained by the drainage system grate assembly 10 would readily corrode metal. Conversely, metal may be appropriate where additional strength is required. The frame 12 may even be molded into the surrounding material 16 in some situations.

The 12 frame optionally includes an anchor flange 26 on its lateral side. An anchor, such as anchor strap 28, may be secured to the anchor flange 26 with an anchor securing element 30 to provide for a more secure anchor into the surrounding material 16. This is especially useful if the surrounding material 16 is concrete or other solid material. The anchor flange 26 and anchor strap 28 may also be provided as one integral piece so that an anchor securing element 30 is not needed. Alternatively, a plurality of anchor flanges 26 may be spaced in reasonably close proximity with each other and provided with threads on their proximal sides so that bolts may be screwed to the frame between the anchor flanges 26, the threads of the bolt engaging the threads of the anchor flanges 26. In this configuration, the bolts function as anchors and no additional anchor securing element 30 is necessary.

The frame 12 may also include structures to allow multiple frames to be affixed together end-to-end. For example, a rectangular splice bar may be partially placed within the generally rectangular cavity formed by a first frame 12 and the anchor flange 26 of the first frame 12. The other portion of the splice bar would then be placed within a corresponding rectangular cavity formed by a second frame and the anchor flange of the second frame. In this way, multiple frame section may be placed end-to-end while maintaining the alignment among the individual frame sections.

The liner 18 may be positioned below the frame 12 to define a path for a fluid. In one embodiment, the liner 18 is approximately 6.6929 cm (2.635 inches) tall, 3.81 cm (1.5 inches) wide, and 60.96 cm (24 inches) long, though the size and proportions may be changed without darting from the scope of the invention. The liner 18 may be constructed of metal, plastic, concrete or any other material and may have any cross-section. For example, the liner 18 may have a U-shaped cross-section with vertical upstanding sidewalls and a bottom portion that is semi-circular or the liner 18 may have vertical upstanding sidewalls and a bottom portion that is flat and generally horizontal, as shown in FIGS. 1-3.

The liner 18 may include an end plate to define the end of a watercourse. The face of the end plate is the same shape as the cross-section of the liner 18. The end plate additionally includes a flange extending perpendicularly from the face of the end plate and extending circumferentially around the end plate, except at the top. The end plate is slightly smaller than the liner so that the circumferential flange may be placed within the liner with the face of the end plate flush with the end of the liner 18. The end plate may be affixed to a liner 18 by any means, or combination of means, including screws, rivets, adhesives, welding, or the like. In one embodiment, the end plate is affixed to the liner 18 with silicone caulk so that a waterproof seal is created between the end plate and the liner 18.

The liner 18 may also include splice plates for joining a first liner to a second liner. In one embodiment, the splice plate is substantially the same shape as the liner 18, but is shorter and slightly reduced in size so that it fits within the liner 18 such that each outer face of the splice plate aligns with and contacts each interior face of the liner 18. A single splice plate is affixed to the interior of the gap formed by a first liner 18 and a second liner placed end-to-end. The splice plate may be affixed to the first liner 18 and the second liner by any means, or combination of means, including screws, rivets, adhesives, welding or the like. In one embodiment, the splice plate is affixed to the first liner 18 and the second liner with silicone caulk so that a waterproof seal is created between the splice plate, the first liner and the second liner.

The grate 14 broadly includes at least one crossbar 24, a plurality of tread bars 32, and a pin 34 for securing the plurality of tread bars 32 within the crossbar 24.

As best shown in FIG. 3, the crossbar 24 has a pair of vertically oriented sidewalls 36 and a plurality of spaced-apart upstanding knuckles 38. Each of the knuckles 38 has a horizontally extending pin hole 40 axially aligned with the pin holes 40 of the other knuckles 38 for receiving the pin 34, as described below. The crossbar 24 is positioned on and supported on each lateral end by the frame 12. The crossbar 24 positions and supports the tread bars 32. One embodiment of the crossbar 24 is approximately 4.92125 cm (1.9375 inches) wide, 2.936875 cm (1.15625 inches) tall, and 60.96 cm (24 inches) long, though the size and proportions may be changed without departing from the scope of the invention. The crossbar 24 is approximately as wide as the frame 12. Spaces between the plurality of knuckles 38 define a plurality of channels 42 for receiving the tread bars 32.

The crossbar 24 may be constructed of metal, plastic or any other suitable material. For example, a plastic crossbar 24 may be appropriate in situations where the fluid contained by the drainage system grate assembly 10 would readily corrode metal. Conversely, a metal crossbar 24 may be appropriate where additional strength is required. In the embodiment shown in FIG. 1, the lower portion of the crossbar 24 has an inverted-U-shaped cross section when viewed from the side. Various other shapes are possible including a solid crossbar.

In the embodiment shown in FIG. 3, the grate 14 has two crossbars 24 per length of tread bar 32. More crossbars 24 may be used, if desired. For example, three or more crossbars 24 per length of tread bar 32 may be used to provide additional support to the tread bars 32. Alternately, in another embodiment, the tread bars 32 are arranged in a staggered formation and four or more crossbars 24 per length of tread bar 32 are utilized to accomplish the staggered formation.

The knuckles 38 of the crossbar 24 may be formed of the same material as or a different material than the vertical sidewalls 36. The knuckles 38 may be integral with the vertical sidewalls 36 or may be separately formed and affixed to the vertical sidewalls 36. The knuckles 38 may be affixed to the vertical sidewalls 36 by any method appropriate under the circumstances including screws, bolts, welding, adhesives, or the like.

The knuckles 38 may be any shape appropriate under the circumstances. For example as best shown in FIGS. 1 and 3, the knuckles 38 may be generally trapezoidal when viewed from the side and rectangular when viewed from the front.

Each of the channels 42 may also be any shape appropriate under the circumstances. The shape of the channels is generally dictated by the shape of the tread bars 32. The number of channels 42 may be as few as one and is only limited by the width of the crossbar 24.

Each of the tread bars 32 is generally T-shaped in cross-section and includes a general horizontal upper portion and a vertical lower portion. The tread bars 32 may also be T-shaped, I-shaped or any other shape appropriate under the circumstances. In one embodiment, each tread bar 32 is approximately 0.9525 cm (0.375 inch) wide, 1.27 cm (0.5 inch) tall, and 60.96 cm (24 inches) long, though the size and proportions may be changed without departing from the scope of the invention. Generally the length of each tread bar 32 is significantly greater than its width, but the length, width, and height of the tread bars 32 may vary depending on the application. The upper portion of the tread bar 32 includes an upper surface, two lateral surfaces and a bottom surface. The upper surface may be smooth, ridged, cross-hatched or have some other pattern in relief on its surface to prevent slippage when people or vehicles move across its surface. The lower portion has two lateral surfaces, a bottom surface, and a horizontally extending pin hole 44. The lower portion fits between the knuckles 38 of the crossbar 24 and the pin hole aligns 44 with the pin holes 40 of the crossbar 24. The tread bars 32 may be constructed of metal, plastic or any other material appropriate under the circumstances.

The cross bar pin holes 40 and the tread bar pin holes 44 are generally round, but may be any shape including triangular, square, rectangular, hexagonal or any other shape. The cross-bar pin holes 40 and the tread bar pin holes 44 should be large enough to allow the pin 34 to pass within.

The pin 34 is positioned within the tread bar pin holes 44 and the crossbar 24 pin holes 40 to secure the tread bars 32 in place. The pin 34 is generally the same length as the width of the crossbar 24, but several shorter pins may be used. The pin 34 may be friction-fitted into the crossbar pin holes 40 and the tread bar pin holes 44. Alternatively, when the grate 14 is placed within the frame 12, the pin 34 is secured in place by the vertical sidewalls of the frame 12.

The pin 34 may be constructed of metal, plastic, wood or any other material appropriate under the circumstances. The cross-section of pin 34 may be any shape, but generally the cross-section of pin 34 will correspond to the shape of the cross bar pin hole 40 and the tread bar pin hole 44. In situations where the cross-section of pin 34 does not correspond to the shape of the cross bar pin hole 40 and the tread bar pin hole 44, the cross bar pin hole 40 and the tread bar pin hole 44 should nonetheless be large enough to allow the pin 34 to pass within.

The drainage system grate assembly 10 optionally includes a locking element 46 to secure an assembled grate 14. The locking element 46 includes a bar 48 and a tightening element 50. The bar 48 is approximately the same width as the frame 12. The bar is positioned below the horizontal ledge 20 of the frame 12 and secured in place by the tightening element 50. In this position, the bar 48 provides downward force on the crossbar 24 through the tightening element 50, seating the crossbar 24 more firmly on the frame 12. Similarly, the cross-bar 24 provides upward force on the bar 48 through the tightening element 50, seating the bar 48 more firmly against the horizontal ledge 20 of the frame 12. Additionally, the bar 48 may include vertical members 52 that interlock with the shelf 22 that extends downward from the horizontal ledge 20 to provide a more secure attachment of bar 48 to the horizontal ledge 20.

The bar 48 may be constructed of metal, plastic or any other material appropriate under the circumstances. The tightening element 50 may be a bolt, screw, wire or virtually any fastening device that can secure the bar 48 relative to the crossbar 24.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A drainage system grate assembly for covering and allowing fluid passage into a watercourse, the drainage system grate assembly comprising:

a crossbar having a plurality of spaced-apart upstanding knuckles defining a plurality of spaced-apart channels therebetween, each of the knuckles having a pin-receiving hole;

a plurality of tread bars positioned in the channels between the knuckles of the crossbar, each tread bar having a pin-receiving hole axially aligned with the pin-receiving holes of the knuckles; and a pin that may be positioned within the pin-receiving holes in the knuckles and the tread bars to secure the tread bars in the crossbar.

2. The drainage system grate assembly of claim 1, further comprising a frame for spanning the watercourse wherein the crossbar is set within the frame.

3. The drainage system grate assembly of claim 2, further comprising a locking element operable to secure the crossbar to the frame.

4. The drainage system grate assembly of claim 2, wherein the frame includes a horizontal ledge protruding towards the opposing side of the frame.

5. The drainage system grate assembly of claim 4, wherein the frame includes a shelf extending downwardly from each horizontal ledge.

6. The drainage system grate assembly of claim 5, wherein the locking element comprises an upturned vertical member adapted to interface with and contact the downwardly extending shelf of the frame so as to secure the crossbar to the frame.

7. The drainage system grate assembly of claim 3, wherein the frame has a width and the locking element includes a bar having a length approximately the same as the width of the frame.

8. The drainage system grate assembly of claim 3, wherein the locking element is raised along a generally vertical axis, so as to engage the locking element in a securing relationship with the frame.

9. The drainage system grate assembly of claim 1, wherein a top of the tread bars positioned and secured to the crossbar by the pin is generally flush with a surface adjacent to the watercourse when installed.

10. The drainage system grate assembly of claim 1, wherein the tread bar has a generally T-shaped cross-section.

11. The drainage system grate assembly of claim 2, further comprising:

a liner disposed within the frame for providing a pathway for a liquid.

12. The drainage system grate assembly of claim 1, wherein the grate is a first grate and the drainage system further comprises a second grate positioned adjacent the first grate.

13. The drainage system grate assembly of claim 1, wherein the crossbar is a first crossbar and the pin is a first pin, and the drainage system further comprises a second crossbar and a second pin wherein the first pin and the second pin secure opposing ends of the plurality of tread bars in the first crossbar and the second crossbar.

14. The drainage system grate assembly of claim 1, further comprising:

an anchor strap flange extending laterally from an outside surface of the frame; and an anchor strap securable to the anchor strap flange and extending generally laterally from the anchor strap flange for providing a secure anchor for the frame when installed.

15. The drainage system grate assembly of claim 2, wherein the frame locks the pin in position.

16. The drainage system grate assembly of claim 2, wherein the pin is friction fit into the pin-receiving holes in the knuckles and the pin-receiving holes in the tread bars.

17. A drainage system grate assembly for covering and allowing fluid passage into a watercourse, the drainage system grate assembly comprising:

a frame having a length and a width, wherein the frame spans the watercourse along the frame's width;

a grate set within the frame and including— first and second spaced-apart crossbars, each having a plurality of spaced-apart upstanding knuckles defining a plurality of spaced-apart channels therebetween, each of the knuckles having a pin-receiving hole, a plurality of tread bars positioned in the channels between the knuckles of the first crossbar and the second crossbar so as to span the gap between the first and second crossbars, each tread bar having a pin-receiving hole axially aligned with the pin-receiving holes of the knuckles; and a first pin and a second pin positioned within pin-receiving holes in the knuckles and the tread bars, to secure the tread bars in the crossbar, wherein the first crossbar and the first pin, and the second crossbar and the second pin secure opposing ends of plurality of tread bars; and a locking element structurally separate from the frame and grate and of a rigid construction for securing the crossbar to the frame.

18. The drainage system grate assembly of claim 17, wherein the frame includes a horizontal ledge protruding towards the opposing side of the frame.

19. The drainage system grate assembly of claim 18, wherein the frame includes a shelf extending downwardly from each horizontal ledge.

20. The drainage system grate assembly of claim 17, wherein the locking element comprises an upturned vertical member adapted to interface with and contact the downwardly extending shelf of the frame so as to secure the crossbar to the frame.

21. The drainage system grate assembly of claim 17, wherein the locking element includes a bar having a length approximately the same as the width of the crossbar.

22. The drainage system grate assembly of claim 17, wherein the locking element is raised along a generally vertical axis, so as to engage the locking element in a securing relationship with the frame.

23. The drainage system grate assembly of claim 17, wherein a top of the tread bars positioned and secured to the crossbar by the pin is generally flush with an adjacent surface when installed.

24. The drainage system grate assembly of claim 17, wherein the frame locks the pin in position.

25. The drainage system grate assembly of claim 17, wherein the pin is friction fit into the pin-receiving holes in the knuckles and the pin-receiving hole in the tread bars.

* * * * *